US005189702A

United States Patent [19]

Sakurai et al.

[11] Patent Number: 5,189,702

[45] Date of Patent: Feb. 23, 1993

[54] VOICE PROCESSING APPARATUS FOR VARYING THE SPEED WITH WHICH A VOICE SIGNAL IS REPRODUCED

[75] Inventors: Atsushi Sakurai, Yokohama; Junichi Tamura, Atsugi, both of Japan

[73] Assignee: Canon Kabushiki Kaisha, Tokyo, Japan

[21] Appl. No.: 770,136

[22] Filed: Oct. 2, 1991

Related U.S. Application Data

[63] Continuation of Ser. No. 600,241, Oct. 22, 1990, abandoned, which is a continuation of Ser. No. 151,549, Feb. 2, 1988, abandoned.

[30] Foreign Application Priority Data

Feb. 16, 1987 [JP] Japan ..... 62-031581

[51] Int. Cl.[5] ..... G10L 3/00

[52] U.S. Cl. ..... 381/51; 381/34

[58] Field of Search ..... 381/29-40, 381/51-53; 395/2

[56] References Cited

U.S. PATENT DOCUMENTS

| | | | |
|---|---|---|---|
| 4,435,832 | 3/1984 | Asada et al. | 381/51 |
| 4,577,343 | 3/1986 | Oura | 381/51 |
| 4,624,012 | 11/1986 | Li et al. | 381/51 |
| 4,700,393 | 10/1987 | Masuzawa et al. | 381/51 |
| 4,709,390 | 11/1987 | Atal et al. | 381/51 |

*Primary Examiner*—Emanuel S. Kemeny
*Assistant Examiner*—Michelle Doerrler
*Attorney, Agent, or Firm*—Fitzpatrick, Cella, Harper & Scinto

[57] ABSTRACT

A voice processing apparatus capable of varying the speed of speech, in which a voice of a predetermined duration is represented by feature parameters and propriety information indicating whether a change in the speech speed is permitted or not. During voice synthesis, the speech speed is varied by skipping or repeating only the feature parameters for which the variation in speech speed is permitted by the associated propriety information.

17 Claims, 10 Drawing Sheets

| FRAME | PROPRIETY INFORMATION e | FEATURE PARAMETERS |
|---|---|---|
| 1 | 0 | $P_1$ , $A_1$ , $K_{11}$ ---- |
| 2 | 0 | $P_2$ , $A_2$ , $K_{21}$ ---- |
| | | |
| | | |
| i-3 | 0 | $P_{i-3}$, $A_{i-3}$, $K_{i-31}$ ---- |
| i-2 | 0 | $P_{i-2}$, $A_{i-2}$, $K_{i-21}$ ---- |
| i-1 | 0 | $P_{i-1}$, $A_{i-1}$, $K_{i-11}$ ---- |
| i | 1 | $P_i$ , $A_i$ , $K_{i1}$ ---- |
| i+1 | 0 | $P_{i+1}$, $A_{i+1}$, $K_{i+11}$ ---- |
| i+2 | 0 | $P_{i+2}$, $A_{i+2}$, $K_{i+21}$ ---- |
| i+3 | 0 | $P_{i+3}$, $A_{i+3}$, $K_{i+3}$ ---- |
| i+4 | 0 | $P_{i+4}$, $A_{i+4}$, $K_{i+41}$ ---- |
| i+5 | 0 | $P_{i+5}$, $A_{i+5}$, $K_{i+51}$ ---- |
| | | |
| | | |
| N-1 | 0 | $P_{N-1}$, $A_{N-1}$, $K_{N-11}$ ---- |
| N | 0 | $P_N$ , $A_N$ , $K_{N1}$ ---- |

FIG. 4

| RATE OF UTTERANCE (v) | PERIOD (m) | |
|---|---|---|
| -4 | 2 | REPETITION |
| -3 | 3 | |
| -2 | 4 | |
| -1 | 5 | |
| 0 | 6 | NORMAL |
| 1 | 5 | THINNING -OUT |
| 2 | 4 | |
| 3 | 3 | |
| 4 | 2 | |

FIG. 5A

| RATE OF UTTERANCE (v) | THRESHOLD (t) | PERIOD (m) |
|---|---|---|
| -4 | 3 | 2 |
| -3 | 2 | 3 |
| -2 | 1 | 4 |
| -1 | 0 | 5 |
| 0 | -1 | 6 |
| 1 | 0 | 5 |
| 2 | 1 | 4 |
| 3 | 2 | 3 |
| 4 | 3 | 2 |

FIG. 5B

| FRAME | PROPRIETY INFORMATION e | v = 2 | v = 3 | v = 4 | v = -4 |
|---|---|---|---|---|---|
| i - 2 | 0 | × | × | × | ◎ |
| i - 1 | 0 | | | | |
| i | 1 | | | | |
| i + 1 | 0 | | × | × | ◎ |
| i + 2 | 0 | × | | × | ◎ |
| i + 3 | 0 | | | | |
| i + 4 | 0 | | × | × | ◎ |
| i + 5 | 0 | | | | |

FIG. 7A

| FRAME | PROPRIETY INFORMATION $e_2$ | v = 2 | v = 3 | v = 4 | v = -4 |
|---|---|---|---|---|---|
| i - 2 | 0 | × | × | × | ◎ |
| i - 1 | 0 | | | | |
| i | -8 | | | | |
| i + 1 | -3 | | | × | |
| i + 2 | 2 | | × | × | ◎ |
| i + 3 | 1 | × | | | |
| i + 4 | 0 | | × | × | ◎ |
| i + 5 | 0 | | | | |

FIG. 7B

| PROPRIETY INFORMATION | 0 | 0 | 1 | 0 | 0 | 0 | 0 | 0 |
|---|---|---|---|---|---|---|---|---|
| v = 2 | × | | | | × | | | |
| v = 3 | × | | | × | | | × | |
| v = 4 | × | | | × | × | | × | |
| v = -4 | ◎ | | | ◎ | ◎ | | ◎ | |

| PROPRIETY INFORMATION | 0 | 0 | -8 | -3 | 2 | 1 | 0 | 0 |
|---|---|---|---|---|---|---|---|---|
| v = 2 | × | | | | | × | | |
| v = 3 | × | | | | × | | × | |
| v = 4 | × | | | × | × | | × | |
| v = -4 | ◎ | | | | ◎ | | ◎ | |

| FRAME | PROPRIETY INFORMATION (e2) | FEATURE PARAMETERS |
|---|---|---|
| 1 | 3 | $P_1$ , $A_1$ , $K_{11}$ ---- |
| 2 | 2 | $P_2$ , $A_2$ , $K_{21}$ ---- |
| | | |
| | | |
| i-3 | 0 | $P_{i-3}$, $A_{i-3}$, $K_{i-31}$ ---- |
| i-2 | 0 | $P_{i-2}$, $A_{i-2}$, $K_{i-21}$ ---- |
| i-1 | 0 | $P_{i-1}$, $A_{i-1}$, $K_{i-11}$ ---- |
| i | -8 | $P_i$ , $A_i$ , $K_{i1}$ ---- |
| i+1 | -3 | $P_{i+1}$, $A_{i+1}$, $K_{i+11}$ ---- |
| i+2 | 2 | $P_{i+2}$, $A_{i+2}$, $K_{i+21}$ ---- |
| i+3 | 1 | $P_{i+3}$, $A_{i+3}$, $K_{i+31}$ ---- |
| i+4 | 0 | $P_{i+4}$, $A_{i+4}$, $K_{i+41}$ ---- |
| i+5 | 0 | $P_{i+5}$, $A_{i+5}$, $K_{i+51}$ ---- |
| | | |
| | | |
| N-1 | 2 | $P_{N-1}$, $A_{N-1}$, $K_{N-11}$ ---- |
| N | 3 | $P_N$ , $A_N$ , $K_{N1}$ ---- |

FIG. 9

VOICE PROCESSING APPARATUS FOR VARYING THE SPEED WITH WHICH A VOICE SIGNAL IS REPRODUCED

This application is a continuation of application Ser. No. 07/600,241 filed Oct. 22, 1990, now abandoned, which is a continuation of Ser. No. 151,549 filed Feb. 2, 1988, now abandoned.

BACKGROUND OF THE INVENTION

1. Field of the Invention

The present invention relates to a voice processing apparatus, and more particularly to a voice processing apparatus capable of varying the speech speed by skipping or repeating the feature parameters used in the voice synthesis.

2. Related Background Art

Voice signals are almost constant within a certain period. This fact is utilized in the conventional voice synthesizing process, in which a voice signal is analyzed in each predetermined period and is represented by a set of feature parameters in each period, and, at the voice synthesis, the voice signal is reproduced in each period by the feature parameters stored in advance. This process is practical since the synthesizing operation is very simple and the deterioration in voice quality is limited. In this process, a set of feature parameters corresponds to the voice of a predetermined period. Consequently the duration of the synthesized voice can be changed by suitably skipping or repeating the sets of feature parameters. It has conventionally been tried to vary the speech speed by this method. However plosive consonants (k, t, p, b, d, g, r, etc.) are represented by only one or two sets of parameters at maximum since these consonants have a short duration. Consequently, in the conventional process, the clarity of speech is significantly deteriorated if the skipped or repeated set of parameters happens to correspond to a plosive consonant.

SUMMARY OF THE INVENTION

An object of the present invention is to eliminate the drawbacks in the above-explained conventional technology and to provide a voice processing apparatus which does not deteriorate the clarity of speech even when the speech speed is varied.

Another object of the present invention is to provide a voice processing apparatus equipped with memory means for storing feature parameters corresponding to the voice in a predetermined period and propriety information corresponding at least to each set of said feature parameters and indicating whether speech speed control is permitted or not, and speed control means adapted, at the voice synthesis, for skipping or repeating only the feature parameters for which the speed control is permitted by the information.

Still another object of the present invention is to provide a voice processing apparatus equipped with memory means for storing feature parameters corresponding to the voice in a predetermined period and multi-value information corresponding at least to each set of said feature parameters and indicating whether speech speed control is permitted or not; threshold value setting means for setting a threshold value according to the speech speed, and speed control means adapted, at the voice synthesis, for skipping or repeating only the feature parameters of which multi-value information is smaller than the threshold value.

Still another object of the present invention is to provide a voice processing apparatus equipped with memory means for storing multi-value information which assumes a maximum value corresponding to feature parameters indicating the pronunciation of a plosive consonant, and decreases in value corresponding to succeeding feature parameters.

Still another object of the present invention is to provide a voice processing apparatus equipped with speed control means which unconditionally forbids the repeated use of feature parameters if the corresponding multi-value information has a predetermined sign.

Still another object of the present invention is to provide a voice processing apparatus equipped with threshold value setting means for setting a higher threshold value if the speech speed becomes higher or lower than a standard speed.

BRIEF DESCRIPTION OF THE DRAWINGS

FIG. 4 is a chart showing the structure of a set of feature parameters and propriety information for enabling or disabling speed control in the first embodiment;

FIG. 5A is a chart showing the relation between a speed instruction v and a period m of skipped or repeated use in the first embodiment;

FIG. 5B is a chart showing the relation among the speech speed v, threshold value t and period m of skipped or repeated use in a second embodiment;

FIG. 7A is a chart showing the results of processing in response to four speed instructions v, for the propriety information e in the first embodiment;

FIG. 7B is a chart showing the results of processing in response to four speed instructions v for the propriety information $e_2$ in the second embodiment;

FIG. 9 is a chart showing the structure of a set of the feature parameters and propriety information in the second embodiment.

DETAILED DESCRIPTION OF THE PREFERRED EMBODIMENTS

Now the present invention will be clarified in detail by embodiments thereof shown in the attached drawings.

In an embodiment, the memory means stores feature parameters corresponding to the voice of a predetermined period, and information corresponding at least to each set of the feature parameters and enabling or disabling speech speed control (for example binary information). Speed control means is adapted, at the voice synthesis, for skipping or repeating only the feature parameters for which speed control is permitted by the information.

In another embodiment, the memory means stores feature parameters corresponding to a voice of a predetermined period, and multi-value information corresponding at least to each set of the feature parameters and enabling or disabling speech speed control. Preferably the memory means stores a maximum multi-value information corresponding to the feature parameters indicating the point of pronunciation of a plosive consonant, and decreasing multi-value information corresponding to the succeeding feature parameters. Threshold value setting means sets threshold value in response to the speech speed, for example an external instruction for the speech speed. Preferably the means sets a higher threshold value as the speech speed becomes higher or lower than a standard speed. Speed control means is adapted, at the voice synthesis, for skipping or repeating only the feature parameters of which multi-value information are smaller than the threshold value. Preferably the speed control means does not repeat the feature parameters unconditionally when the multi-value information has a particular sign.

First Embodiment

Figure 1:
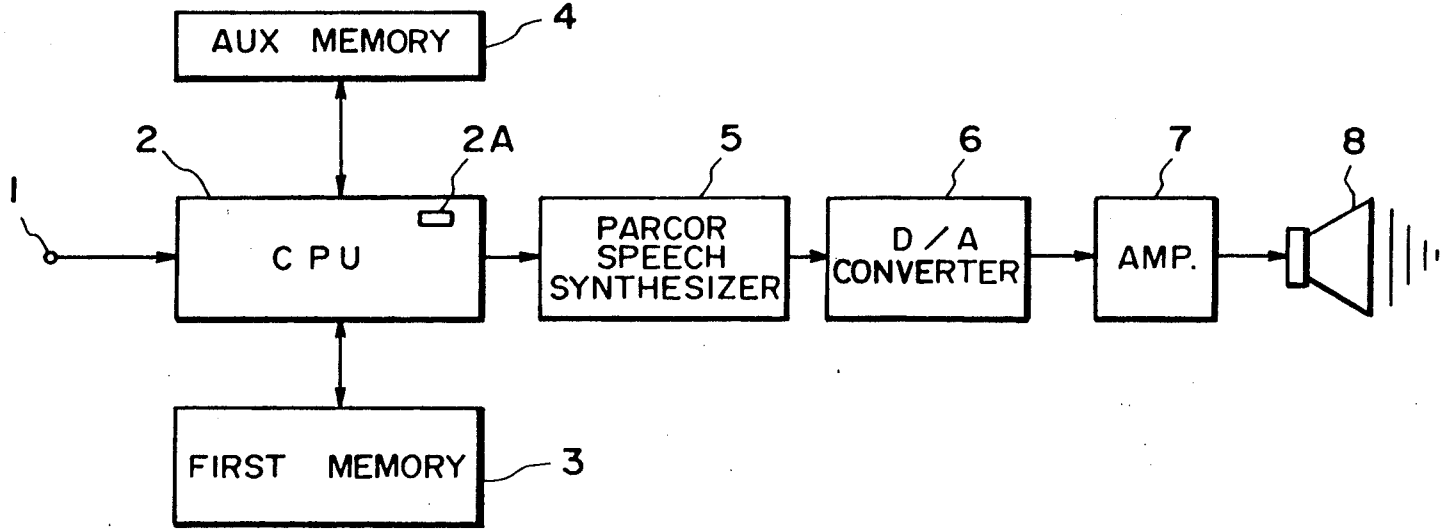
FIG. 1 is a block diagram of the voice processing apparatus constituting a first embodiment of the present invention.
Figure 6:
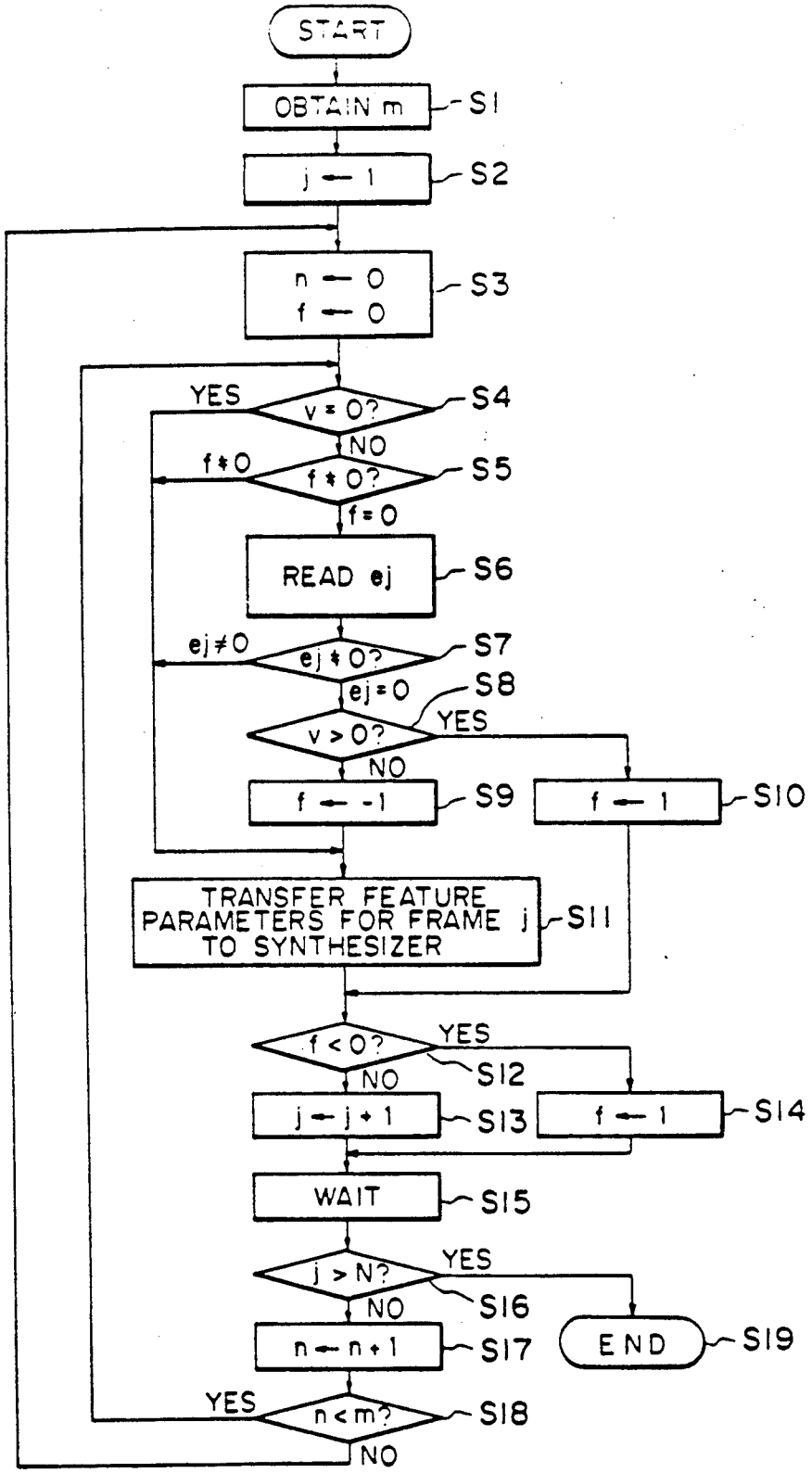
FIG. 6 is a flow chart showing the sequence of speed control in the first embodiment.
Figure 10:
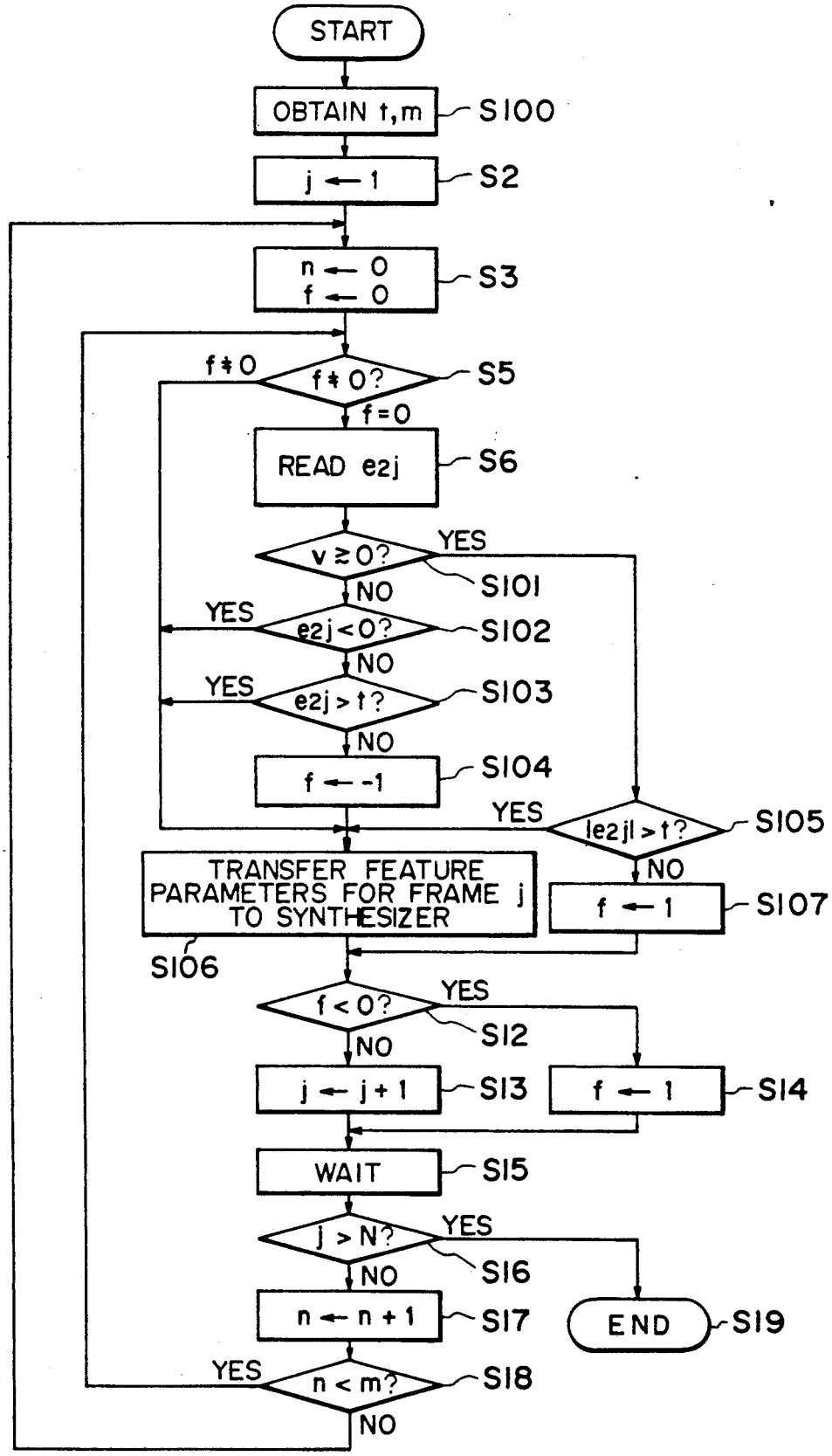
FIG. 10 is a flow chart showing the sequence of speed control in the second embodiment.

FIG. 1 is a block diagram of the voice synthesizing apparatus constituting a first embodiment of the present invention, in which there are shown an input terminal 1 for receiving a speech instruction and a speed instruction from an unrepresented host equipment; a central processing unit (CPU) 2 for controlling the speech synthesis and the speed thereof according to the received speech instruction and speed instruction; a memory (ROM) 2A storing a control program to be executed by the CPU 2, such as that of the first embodiment shown in FIG. 6 or that of the second embodiment shown in FIG. 10; a first memory 3 storing the sets of the propriety information for enabling speed control and the feature parameters of the voice; an auxiliary memory 4 used by the CPU 2; a PARCOR speech synthesizer 5; a D/A converter 6; an amplifier 7; and a loudspeaker 8 for voice output.

Figure 2A:
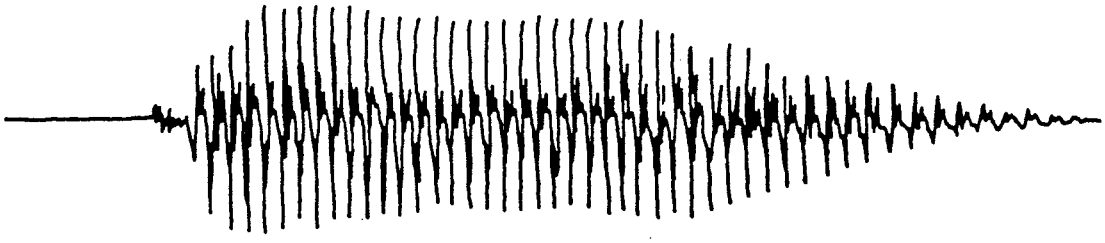
FIGS. 2A to 2C are charts showing voice waves "tai" constituting a part of a word "mitai" pronounced by a same male.
Figure 2B:
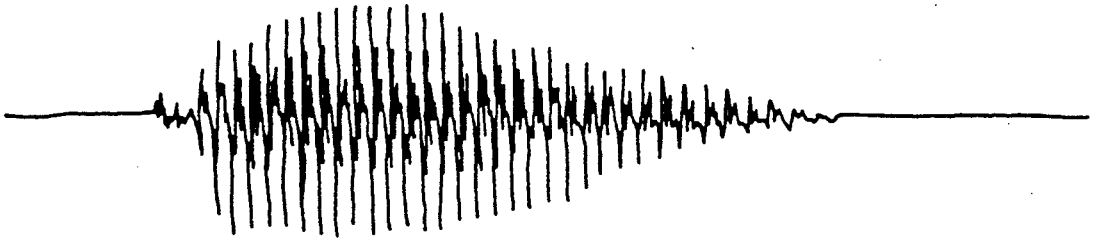
Figure 2C:
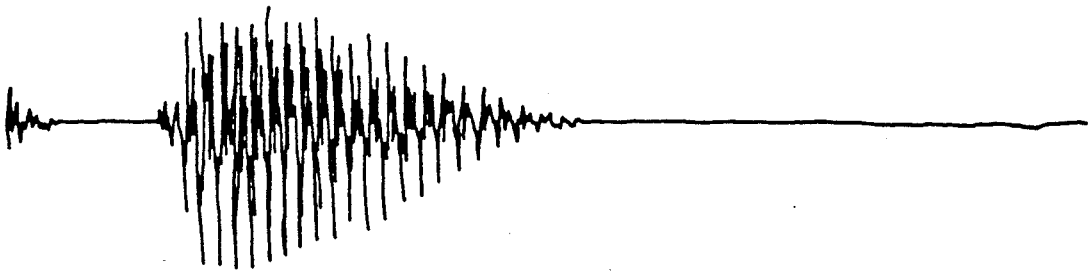

FIGS. 2A to 2C are charts showing the wave forms "tai" constituting a part of a word "mitai" (which reads "mi-ta-i" and means "wish to look at") pronounced by a same male, in which FIG. 2A shows the wave form when pronounced clearly, while FIG. 2B shows the wave form when pronounced with a speed of about 1.5 times, and FIG. 2C shows the wave form when pronounced with a speed of about 2 times.

Figure 3A:
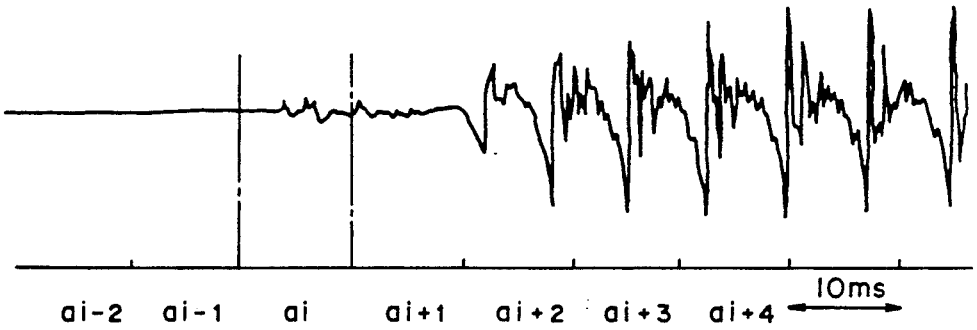
FIGS. 3A to 3C are charts showing a part of the wave forms shown in FIGS. 2A to 2C, expanded in time with a same rate of magnification.
Figure 3B:
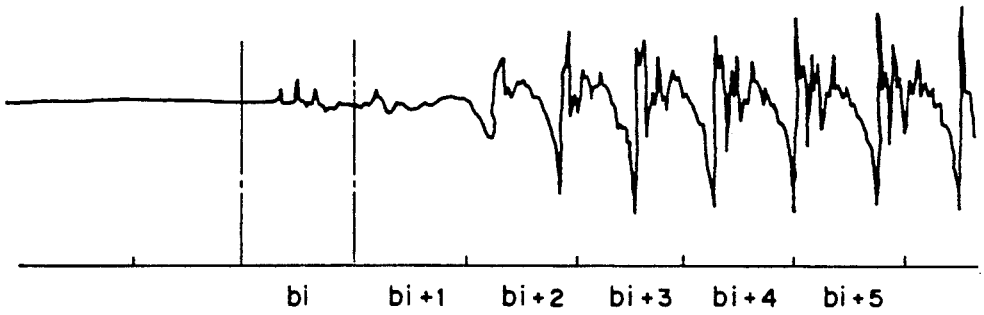
Figure 3C:
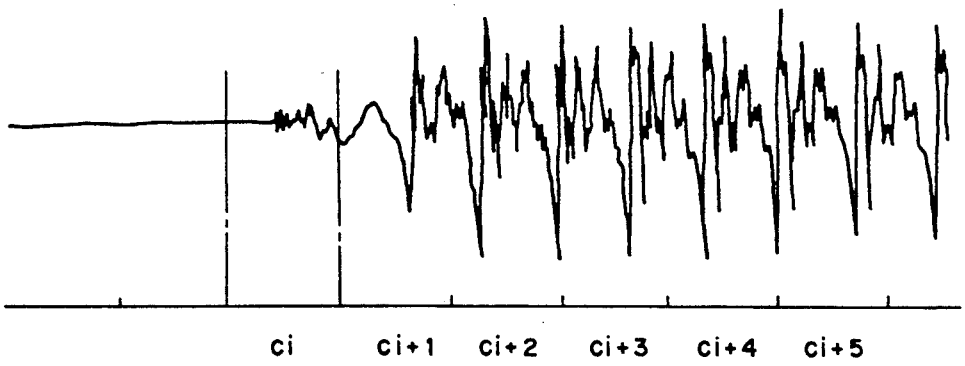

FIGS. 3A to 3C show a part of the voice wave forms in FIGS. 2A to 2C, expanded in the direction of time by a same magnification, and indicating the initial portion of a sound "ta". Each gradation under the wave form indicates a time frame of 10 ms, and each frame represents the voice wave form by a set of feature parameters. For example a frame ($a_i$) in FIG. 3A represents the feature at the explosion of a consonant "t". As will be apparent from the comparison with a frame ($b_i$) in FIG. 3B or a frame ($c_i$) in FIG. 3C, this feature is scarcely affected by the speech speed. Conversely, in case of varying the speech speed, if such feature frame is skipped or repeated, the feature is significantly changed and the clarity of speech deteriorates. The situation is same for other plosive consonants (k, p, d, g, r, etc.). In the first embodiment, therefore, the feature parameters obtained by analyzing the voice wave form in each frame are stored together with propriety information for enabling or disabling the speed control, and the information is made "negative" for a frame not to be subjected to skipping or repeating, such as the frame at the explosion of a plosive consonant.

FIG. 4 shows the structure of a set of feature parameters and propriety information in the first embodiment. A male voice "mitai", analyzed in frames of 10 m/sec each, provides N frames of the set of feature parameters, and the set of feature parameters in each frame consists of a pitch $P_i$ (i indicating the frame number), an amplitude $A_i$ and a PARCOR coefficient $K_i$. Also each frame is accompanied by propriety information e for speed control which enables or disables the speed control (skipping or repeating) respectively at "0" or "1".

FIG. 5A shows the relation between a speed instruction v and a period m of skipped or repeated use of a frame, in the first embodiment. The speed instruction v assumes a value "0" for a standard speed. In such case the CPU 2 releases all the sets of feature parameters shown in FIG. 4 without change. The speed instruction v assumes a positive integral value from "1" to "4" for faster speeds than the standard. In such case the CPU 2 determines the period m by a calculation $m=6-|v|$, and, since the speed instruction v is positive, executes a skipping control at every period m. More specifically, it examines the propriety information e at every m frames, and, if the information e is "0" (enable), skips the set of feature parameters of the frame in the transfer to the PARCOR speech synthesizer 5. For slower speeds than the standard, the speed instruction v assumes a negative integral value from "−1" to "−4". In such case the CPU 2 determines the period m by a calculation $m=6-|v|$, and, since the speed instruction v is negative, executes a repeating control at every period m. More specifically, it examines the information e at every m frames, and, if the information e is "0" (enable), repeates the set of feature parameters of the frame in the transfer to the PARCOR speech synthesizer 5.

FIG. 6 shows a flow chart of the speed control sequence of the first embodiment. The sequence is started in response to the speech instruction and the speed instruction v received by the input terminal 1 shown in FIG. 1. In FIG. 5, a variable j indicates the frame number and assumes a value from 1 to N. A variable n (period counter) is used for counting the period m for skipped or repeated use, and assumes a value from 0 to $m-1$. A flag f indicates the completion of skipping or repeating in a period, and is reset to "0" together with the period counter at the start of every period and is set to "1" after skipping or repeating. Also the flag f is temporarily set at "−1" for indicating the use of same feature parameters twice.

Initial Process

A step S1 determines the period m by a calculation $m=6-|v|$, and a step S2 sets the frame number j at "1" to enable access to the parameters of the frame (1) including the propriety information e. Then a step S3 resets the period counter n and the flag f, and a step S4 examines the speed instruction v.

Speech at Standard Speed

If the step S4 identifies the speed instruction v as "0", indicating the speed at the standard speed, the sequence proceeds to a step S11 for transferring the set of feature parameters of a processed frame j to the PARCOR speech synthesizer 5. The synthesizer 5 executes synthesis of voice information according to the transferred set of feature parameters, and the voice information is converted by the D/A-converter 6 into an analog signal which is amplified by the amplifier 7 and released from the loudspeaker 8.

In the meantime the CPU 2 examines the flag f in a step S12, and, since it is not "−1", the sequence proceeds to a step S13 for increasing the frame number j by one. Then a step S15 waits for a time approximately equal to a frame (about 10 m/sec), and a step S16 discriminates whether the frame number j has reached the total frame number N. If the number N has been reached, indicating the completion of outputs in all the frames, the sequence proceeds to a step S19 to terminate the sequence. On the other hand, if N has not been reached, the sequence proceeds to a step S17 for increasing the period counter n by one. Then a step S18 discriminates if $n<m$, and, if $n<m$ indicating that a period has not been completed, the sequence returns to the step S4 for reading a next frame. On the other hand, if not $n<m$, i.e., $n=m$ indicating the start of a new period, the sequence returns to a step S3 for resetting the period counter n and the flag f. In this manner, in the speech at the standard speed, the sets of feature parameters of all the frames N are unconditionally released.

Faster Speech than the Standard Speed

If the step S4 identifies the non-zero state of the speed instruction v, the speech is faster or slower than the standard speed. For a positive speed instruction v indicating a faster speech than the standard speed, the following skipping process is executed. Whether a skipping process is enabled or not is identified at the step S3 in which the period counter n and the flag f are reset to zero at the start of a period A step S5 examines the flag f, which is "0" at first. Consequently the sequence proceeds to a step S6 to read the propriety information $e_j$, for enabling or disabling speed control for the processed frame. A step S7 then examines if the information $e_j$ is zero, and, if zero indicating that the speed control is enabled for said frame, the sequence proceeds to a step S8 for examining the sign of the speed instruction v. Since it is positive in this case, the sequence proceeds to a step S10 for setting the flag f to "1" indicating the completion of a skipping process. Then a step S12 discriminates if the flag f is negative, and , since it is not negative in this case, the sequence proceeds to a step S13 for increasing the frame number j by one. In this manner the skipping process is executed by increasing the frame number by one without executing the step S11. Then a step S15 waits for a time, which however is not equal to a frame time in this case. It is to be noted that the flag f is not "0" when the sequence returns to the step S5. Thereafter, in the same period, the sequence always proceeds from the step S5 to the step S11 for reading and transferring the sets of feature parameters to the PARCOR speech synthesizer 5 in succession, as explained in the speech with the standard speed. In this manner the propriety information $e_j$ of a first frame in every period m is examined, and, if the speed control is enabled, the set of feature parameters of the frame is skipped.

However, if the step S7 identifies that information $e_j$ of the frame is "1", the feature parameters of the frame are not skipped. The sequence proceeds to the step S11 for transferring the set of feature parameters of the frame to the PARCOR speech synthesizer 5. As the flag f is not set at "1" in this frame processing, the flag f is identified as "0" when the step S5 is executed next time. Then the step S6 discriminates the information $e_{j+1}$ of a next frame, and, if it is zero, a skipping process is executed on the frame. In summary, for a faster speech than the standard speed, a skipping process is executed at every period m, and, if the set of feature parameters cannot be skipped in a frame, a skipping process is executed on a next frame according to the information e thereof. Consequently a faster speech than the standard speed can be faithfully realized, and still the important frame at the pronunciation of plosive consonants is not lost.

Speech Slower than the Standard Speed

When the step S8 identifies a negative speed instruction v, indicating a slower speech than the standard speed, the following repeating process is executed. Whether a repeating process is enabled or not is discriminated when the period counter n and the flag f are reset to zero in the step S3. The step S5 examines the flag f. Since it is "0" in the beginning, the sequence proceeds to the step S6 for reading the propriety information $e_j$ for enabling or disabling the speed control in the processed frame. The step S7 then discriminates whether the information $e_j$ is "0", and, if "0" indicating that the speed control is enabled for the frame, the sequence proceeds to the step S8 for discriminating the sign of the speed instruction v. Since it is negative in this case, the sequence proceeds to a step S9 for setting the flag f at "−1", indicating the use of same feature parameters twice. Then the step S11 executes the first transfer of the set of feature parameters to the PARCOR speech synthesizer 5. As the next step S12 identifies the flag f as "−1", the sequence proceeds to a step S14 for setting the flag f at "1", indicating the completion of an additional transfer of the set of feature parameters. The frame number is not changed as the step S13 is skipped. In this manner the feature parameters of this frame number are used twice. As the flag f is identified as "1" in the step S5 thereafter, the steps of feature parameters are transferred to the PARCOR speech synthesizer 5 while the frame number j is renewed until the completion of a period.

However, if the step S7 identifies the information $e_j$ as "1", the repeated transfer of the set of feature parameters is not conducted for the frame. The sequence proceeds to the step S11 for transferring the set of feature parameters of the processed frame to the speech synthesizer 5, and then the frame number is increased by one in the step S13. In this manner the flag is not set to "1" in this frame processing, so that the flag f is identified as "0" in a next step S5. Then the step S6 discriminates the information $e_{j+1}$ of a next frame, and, if it is zero, a repeating process is executed on the frame. In summary, for a slower speech than the standard speed, a repeating process is conducted at every period m, and, if the set of feature parameters of a processed frame cannot be repeated, the set of feature parameters of the next frame is repeated according to the propriety information e thereof. In this manner a speech slower than the standard speed is always faithfully realized, and still the important frame at the pronunciation of a plosive consonant is not repeated.

FIG. 7A is a chart showing the results of processing in response to four different speed instructions v, for the propriety information e in the first embodiment. There are shown the results of processing on 8 frames from a frame (i−2) at the start of the voice "ta" to a frame (i+5), wherein a mark "X" indicates a skipped frame, and a mark "◎" indicates a repeated frame. It is assumed that the frame (i−2) is at a multiple of the period m at any speed.

For a speed instruction v=2, the period is m=6−|2|=4. Thus the information e is discriminated at the first frame (i−2) and the next fourth frame (i+2) and are identified as "0" in both cases, so that these frames are both skipped.

For a speed instruction v=3, the period is m=6−|3|=3. Thus the information e is discriminated at the first frame (i−2) and the next third frame (i+1) and are identified as "0" in both cases, so that both frames are skipped.

For a speed instruction v=4, the period is m=6−|4|=2. Thus the information e is discriminated at the first frame (i−2) and the next second frame (i) and the further next second frame (i+2). As the information e is "0" for the frames (i−2) and (i+2), the frames are both skipped. However, since the information e is "1" for the frame (i), the set of feature parameters of the frame is not skipped and the information e for the next frame (i+1) is examined. The frame is then skipped since the information is "0". The average speech speed is therefore not affected, and the set of feature parameters of the frame (i) indicating the time of pronunciation of the plosive consonant "t" is transferred, without, skipping, to the speech synthesizer 5, thereby enabling speech synthesis with clarity.

For a speed instruction v=−4, the period is m=6−|−4|=2. Thus the information e is examined at the first frame (i−2), the next second frame (i) and the further next second frame (i+2). There is conducted a repeated use of frame since the instruction v is negative. The repeated use is conducted for the frames (i−2) and (i+2) since the information e is "0" for these frames. However, since the information e of the frame (i) is "1" (disable), the set of feature parameters of the frame is not repeated, and the information e of a next frame (i+1) is examined, and the repeated used is conducted on this frame as the information e thereof is "0". Also in this case the average speech speed is not affected, and the set of feature parameters of the frame (i) indicating the time of pronunciation of the plosive consonant "t" is transferred to the synthesizer 5 only once, without repetition, so that a clear voice can be synthesized without doubling of the plosive sound.

Figure 8A:
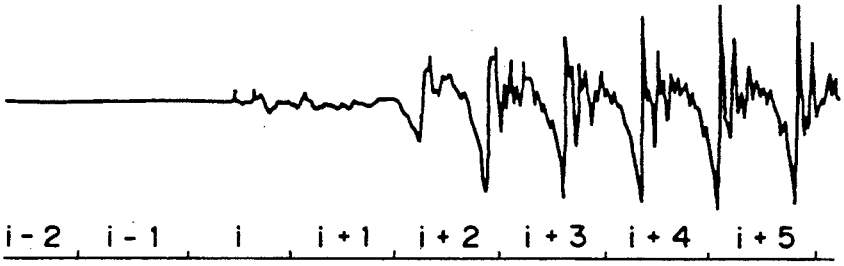
FIG. 8A is a chart showing the results of processing in response to four speed instructions v, for the propriety information e in the first embodiment, together with the wave form of an original voice.

FIG. 8(A) shows the results of processing in response to four different speed instructions v for the propriety information e in the first embodiment, together with the wave form of the original voice, over 8 frames from the frame (i−2) at the start of the voice "ta" to the frame (i+5). As in FIG. 7(A), a mark "X" indicates a skipped frame, and a mark "◎" indicates a repeated frame. As will be apparent from FIG. 8(A), the signal of the frame (i) corresponding to the time of pronunciation of the unvoiced plosive consonant "t" is not subjected to skipping or repeating, regardless of the value of the speech speed v.

Second Embodiment

The block diagram of the second embodiment is same as shown in FIG. 1. The second embodiment is featured by the use of multi-value propriety information, in contrast to the 1-bit information in the first embodiment, thereby achieving flexible skipping or repeating of the frame according to the magnitude of the speed instruction v, and thus enabling the synthesis of more natural and clearer voice even when the speech speed is varied.

Reference is again made to FIG. 3(A), and further consideration is given to the frame ($a_i$) at the pronunciation of the unvoiced plosive consonant "t" and a succeeding frame ($a_{i+1}$). As explained before, no significant change is observed among the frames ($a_i$), ($b_i$) and ($c_i$) at the explosion of the consonant, when the speed instruction v is varied. On the other hand, the next frame ($a_{i+1}$) is almost the same as the next frame ($b_{i+1}$) at the speech speed of 1.5 times, but the next frame ($c_{i+1}$) at the speech speed of 2 times does not have the feature of the frame ($a_{i+1}$). This is because the transfer portion from the consonant "t" to the ensuing vowel "a" becomes shorter as the speech speed increases, and same situation applies for other plosive consonants (k, p, b, d, g, r, etc.).

In the second embodiment, when the speech speed v is changed to a faster speed than the standard, the frame at the pronunciation of the consonant is not skipped, and the skipping method for the succeeding frame of the transfer portion to the succeeding vowel is suitably varied according to the magnitude of the speed instruction v, thereby synthesizing a more natural voice. Also in a speech slower than the standard, it is already known that the feature of a plosive consonant is deteriorated if the duration of the consonant is excessively prolonged. In the second embodiment, therefore, the multi-value propriety information $e_2$ is accompanied by code information prohibiting only the skipping of a frame, thereby preventing the change in the feature of a plosive consonant caused by the repeated use of a frame.

FIG. 9 shows the structure of the set of feature parameters and the propriety information in the second embodiment. The frame number and the set of feature parameters are same as those in FIG. 4, but the information $e_2$ for speed control is different and is composed of multi-value information assuming "0" or a negative or positive integral value.

The information $e_2$ of a frame enables the skipping or repetition of the frame when the absolute value of the information $e_2$ is equal to or less than a threshold value t determined according to the speed instruction v, but the set of feature parameters is released without change if the absolute value is larger than the threshold value.

Also when the information $e_2$ is negative, the corresponding frame is always excluded from the repeated use. Therefore, if the speed instruction v indicates a speech slower than the standard speed, the above-mentioned process is conducted only on the frames for which the information $e_2$ is not negative.

As shown in FIG. 9, the frame (i) at the explosion of the unvoiced plosive consonant "t" is given a maximum absolute value |8|, while succeeding three frames constituting a transfer portion leading to the succeeding vowel "a" are respectively given absolute values |3|, |2| and |1|. Such sloped values realize the skipping or repetition only in the frames closer to the vowel if the speed instruction v is close to the standard speed, (if the threshold value t is low), and such skipping or repetition is extended toward the point of explosion of the consonant if the speed instruction is more deviated from the standard speed (if the threshold value t is high). Besides the frames (i) and (i+1) are given a negative sign and excluded unconditionally from the repeated use, thereby preventing the change in the feature of sound.

FIG. 5B shows the relation among the speech speed v, threshold value t and period m of skipped or repeated use in the second embodiment. As explained before, the speech speed v is "0" for the standard speed, assumes one of positive integral values "1" to "4" for faster speech speeds than the standard, or one of negative integral value "−1" to "−4" for slower speech speeds than the standard. The threshold value t and the period m are determined by the speed instruction v, according to following equations (1) and (2):

$$t=|v|-1 \quad (1)$$

$$m=6-|v| \quad (2)$$

Thus, for the standard speed instruction v="0", the threshold value t is determined as −1 by the equation (1), so that the absolute value of the information $e_2$ cannot be less than the threshold value t. Consequently the sets of feature parameters of all the frames are released without skipping or repetition.

Therefore, in response to the speech instruction and the speed instruction v supplied to the input terminal 1, the CPU 2 determines the threshold value t and the period m from the equations (1) and (2), then, if the speed instruction is "0" or positive, the CPU 2 examines the information $e_2$ at every m frames, and skips the set of feature parameters of a frame if the absolute value of the information $e_2$ of the frame is equal to less than the threshold value t. On the other hand, if the speed instruction v is negative, the information $e_2$ is examined at every m frames, and the set of feature parameters of a frame is repeated if the information $e_2$ thereof is not negative and if the absolute value thereof is equal to or less than the threshold value t.

FIG. 10 shows a flow chart of the speed control sequence of the second embodiment, wherein processes same as those in FIG. 6 are given same step numbers and will not be explained further.

Initial Process

In response to the entry of a speech instruction and a speed instruction v to the input terminal, a step S100 determines the threshold value t and the period m according to the aforementioned equations (1) and (2).

Speech at Standard Speed

If a step S101 discriminates the speed instruction v as "0" indicating the speech at the standard speed, the sequence proceeds to a step S105 for identifying if $|e_{2j}|>t$. At the standard speed, this condition is always satisfied since the threshold value is $t=|0|-1=-1$. Consequently a step S106 is executed for all the frames, thereby obtaining a speech in the standard speed.

Speech Faster than the Standard Speed

A faster speech than the standard is indicated if the step S101 identifies a positive speed instruction v. Whether a skipping process is enabled or not is identified when the period counter n and the flag f are reset to zero in the step S3. The step S6 read the propriety information $e_{2j}$, and a step S105 discriminates if $|e_{2j}|>t$. If this condition is satisfied, the corresponding frame is not skipped and the sequence proceeds to a step S106. As the flag f is not set at "1" in this case, the step S105 executes the discrimination for $|e_{2j}|>t$ also for the next frame. On the other hand, if the condition is not satisfied, the sequence proceeds to a step S107 thereby skipping the corresponding frame and setting the flag f to "1", indicating the completion of a skipping process.

Speech Slower than the Standard Speed

If the step S101 identifies a negative speed instruction v, indicating a speech slower than the standard speed, there is conducted a repeating process as will explained in the following. Whether a repeating process is enabled or not, is identified when the period counter n and the flag f are reset to zero in the step S3. The step S6 reads the propriety information $e_{2j}$, and a step S102 discriminates if $e_{2j}<0$. If this condition $e_{2j}<0$ indicating a frame for which the repeated use is prohibited, the repeated use is unconditionally disabled. The sequence proceeds to the step S106 for transferring the set of feature parameters of the processed frame, and then to the step S13 for renewing the frame number.

If the condition $e_{2j}<0$ is not satisfied, there is conducted a control according to the threshold value. More specifically, a step S103 discriminates if a condition $e_{2j}>t$ is satisfied, and, if satisfied, the processed frame is identified to be prohibited for the repeated use, and is excluded from the repeating process. On the other hand, if the condition is not satisfied, the sequence proceeds to a step S104 for setting the flag at "−1", thereby enabling the repeated use for the frame.

FIG. 7B shows the results of processing in response to four different speed instructions v, for the propriety information $e_2$ of the second embodiment, on 8 frames from the frame (i−2) at the start of the voice "ta" to the frame (i+5). As explained before, a mark "X" indicates a skipped frame, while a mark "◎" indicates a repeated frame. Besides it is assumed that the frame (i−2) corresponds to a multiple of the period m at any speech speed v.

For a speed instruction v=2, a skipping control is executed since v is positive. The threshold value and the period are determined as t=1 and m=4 according to the equations (1) and (2). Therefore the absolute value of the information $e_2$ is compared with the threshold value t at the leading frames (i−2) and (i+2). In the frame (i−2), the skipping is conducted since $|e_{2\,i-2}|=0$ so the threshold value does not exceed t=1. However, in the frame (i+2), the skipping is not executed as the absolute value $|e_{2\,i+2}|$ is equal to 2 and exceeds the threshold value t=1. In a succeeding frame (i+3), the skipping is executed since the absolute value $|e_{2\,i+3}|$ is 1 and is equal to the threshold value t=1. Consequently, in case of speed instruction v=2, the set of feature parameters is skipped in the frames (i−2) and (i+3).

For a speed instruction v=3, a skipping process is executed since v is positive. The threshold value and the period are determined as t=2 and m=3 according to the equations (1) and (2). Consequently the speed control is conducted at the frames (i−2), (i+1) and (i+4). The skipping process is conducted at the frames (i−2) and (i+4) since the absolute value $|e_{2\,i-2}|=|e_{2\,i+4}|$ is equal to zero and is smaller than the threshold value t=2. On the other hand, in the frame (i+1), the skipping process is not conducted since the absolute value $|e_{2\,i+1}|$ is equal to 3 and is larger than the threshold value t=2. In a next frame (i+2) the skipping process is conducted since the absolute value $|e_{2\,i+2}|$ is 2 and is equal to the threshold value t=2. Consequently, for a speed instruction v=3, the set of feature parameters is skipped in the frames (i−2), (i+2) and (i+4).

For a speed instruction v=4, a skipping process is executed since v is positive. The threshold value and the period are determined as t=3 and m=2 according to the equations (1) and (2). Consequently the speed control is conducted at the frames (i−2), (i), (i+2) and (i+4). The skipping process is executed at the frames (i−2), (i+2) and (i+4), as they have respective absolute values $|e_{2\,i-2}|=0$, $|e_{2\,i+2}|=2$ and $|e_{2\,i+4}|=0$, all smaller than the threshold value t=3. However, in the frame (i), the skipping process is not conducted since the absolute value $|e_{2\,i}|$ is equal to 8 and larger than the threshold value t=3. A skipping process is conducted in a next step (i+1) since the absolute value $|e_{2\,i+1}|=3$ is equal to the threshold value t=3. In this manner, for a speed instruction v=4, the set of feature parameters is skipped in the frames (i−2), (i+1), (i+2) and (i+4).

Finally, for a speed instruction v=−4, repeating control is executed as v is negative. The threshold value and the period are determined as t=3 and m=2 according to the equations (1) and (2). Consequently the speed control process is executed at the frames (i−2), (i), (i+2) and (i+4). At each of these frames, the value of the information $e_2$ is examined, and, if not negative, compared with the threshold value t. The repeating process is conducted at the frames (i−2), (i+2) and (i+4) since the information $e_2$ is not negative, and the absolute values thereof $|e_{2\,i-2}|=0$, $|e_{2\,i+2}|=2$ and $|e_{2\,i+4}|=0$ are all smaller than the threshold value t=3. However, in the frame (i) the repeating process is disabled since the information $e_2$ is negative ($e_{2\,i}=-8$). Also the repeating process is not conducted in the remaining frame (i+1) in the same period since $e_{2\,i+1}$ is −3 and negative. Consequently, for a speed instruction v=−4, the set of feature parameters is repeated in the frames (i−2), (i+2) and (i+4).

Figure 8B:
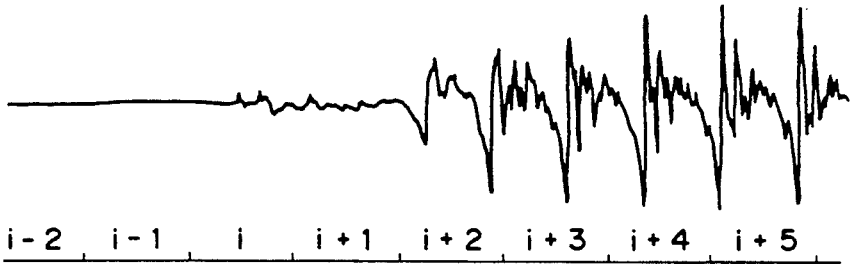
FIG. 8B is a chart showing the results of processing in response to four speed instructions v, for the propriety information $e_2$ in the second embodiment, together with the wave form of an original voice.

FIG. 8B shows the results of processing in response to four different speed instructions v for the propriety information $e_2$ of the second embodiment, together with the wave form of the original voice, on 8 frames from the frame (i−2) at the start of the voice "ta" to the frame (i+5). As in FIG. 7B, a mark "X" indicates a skipped frame, while a mark "◎" indicates a repeated frame. As will be apparent from FIG. 8B , at a speech faster than the standard speed, a frame at the explosion of the unvoiced plosive consonant "t" is always conserved, and the frames (i+1), (i+2) and (i+3) at the transfer portion from the consonant to the succeeding vowel "a" are skipped in succession starting from the one closest to the vowel, flexibly according to the increase in the speech speed. Consequently the synthesized voice conserves the clarity and the natural character regardless of the speech speed v. Also if the speech is slower than the standard speed, the frames (i) and (i+1) showing the feature of the unvoiced plosive consonant "t" are not repeated, so that the consonant is not extended in time in the synthesized voice, thus conserving its feature.

In the foregoing embodiments there have been employed feature parameters including a PARCOR coefficient and a PARCOR speech synthesizer, but any synthesizing process may be employed as long as the voice of a predetermined period is represented by a set of parameters.

Also in the second embodiment, the threshold value t for skipping or repeating is determined by a first-order function of the speed instruction v, but it may also be determined independently for each speed instruction v.

Also in the second embodiment there has been explained the effect of the propriety information $e_2$ on the transfer portion from a plosive consonant to a succeeding vowel, but the present invention is not limited to such embodiment and is evidently applicable to any portion of the voice to be synthesized.

As explained in detail in the foregoing, the present invention enables voice synthesis in a clear and natural manner without a loss in its features or without the omission of sound, since the skipping or repeating of feature parameters, which has conventionally been conducted in a fixed manner, can be made flexibly according to the magnitude of speed instruction v in combination with information for enabling or disabling the speed control. Although the foregoing embodiments have been explained in case of PARCOR speech synthesis, the present invention is not limited to such embodiments. Also the apparatus of the present invention may be provided on a facsimile apparatus or a word processor, for fast or slow output of a transferred or stored document according to a key input, thereby enabling confirmation of such a document with a clear voice.

What is claimed is:

1. A voice processing apparatus for increasing the speed of synthesized speech synthesized by a voice synthesizer, comprising:

memory means for storing a plurality of sets of feature parameters, and for storing information for enabling speech speed control in such a manner as not to skip at least each set of the feature parameters in accordance with whether each set of feature parameters represents the timing of a non-stable portion of generated speech, the information being established based on the duration of speech generated using at least one feature parameter; and speed control means for, during voice synthesis in which a voice signal is synthesized by the voice synthesizer, skipping the sets of the feature parameters, for which the speed control is enabled by the information.

2. A voice processing apparatus according to claim 1, wherein the information for enabling or disabling speech speed control is established irrespective of whether the synthesized speech is voiced or unvoiced.

3. A voice processing apparatus for decreasing the speed of synthesized speech synthesized by a voice synthesizer, comprising:

memory means for storing a plurality of sets of feature parameters, an for storing information for enabling speech speed control in such manner as not to repeat at least each set of the feature parameters in accordance with whether each set of feature parameters represents the timing of a non-stable portion of generated speech, the information being established based on the duration of speech generated using at least one feature parameter; and speed control means for, during voice synthesis in which a voice signal is synthesized by the voice synthesizer, repeating the sets of the feature parameters, for which the speed control is enabled by the information.

4. A voice processing apparatus according to claim 3, wherein the information for enabling or disabling speech speed control is established irrespective of whether the synthesized speech is voiced or unvoiced.

5. A voice processing apparatus comprising:

memory means for storing a plurality of sets of feature parameters, used for voice synthesis by a voice synthesizer and for storing multi-value information for enabling or disabling speech speed control for at least each set of the feature parameters;

threshold value setting means for setting a threshold value in response to the speed with which a voice signal is to be synthesized by the voice synthesizer; and speed control means for, during voice synthesis in which the voice signal is synthesized by the voice synthesizer, skipping or repeating the sets of feature parameters whose corresponding multi-value information are smaller than the threshold value.

6. A voice processing apparatus according to claim 5, wherein said memory means stores a maximum multi-value information corresponding to the feature parameters representing the explosion of plosive consonants, and multi-value information decreasing in value corresponding to the succeeding sets of feature parameters succeeding the sets of feature parameters representing the explosion of plosive consonants.

7. A voice processing apparatus according to claim 5, wherein said speed control means does not repeat the sets of feature parameters unconditionally if the corresponding multi-value information has a predetermined sign.

8. A voice processing apparatus according to claim 5, wherein said threshold value setting means sets a higher threshold value as the speed with which the voice signal is to be synthesized becomes faster or slower than a standard speed.

9. A voice processing method for increasing the speed of synthesized speech synthesized by a voice synthesizer, comprising the steps of:

storing a plurality of sets of feature parameters, and storing information for disabling speech speed control in such a manner that the set of feature parameters are not skipped for at least each set of the feature parameters in accordance with whether each set of feature parameters represents the timing of a non-stable portion of generated speech, the information being established based on the duration of speech generated using at least one feature parameter; and skipping the sets of the feature parameters, for which the speed control is enabled by the information, during voice synthesis in which a voice signal is synthesized by the voice synthesizer.

10. A voice processing method according to claim 9, wherein said storing step comprises the step of storing the information for enabling speech speed control irrespective of whether the synthesized speech is voiced or unvoiced.

11. A voice processing method for decreasing the speed of synthesized speech synthesized by a voice synthesizer, comprising the steps of:

storing a plurality of sets of feature parameters, and storing information for enabling speech speed control in such a manner that the set of feature parameters are not repeated for at least each set of feature parameters in accordance with whether each set of feature parameters represents the timing of a non-stable portion of generated speech, the information being established based on the duration of speech generated using at least one feature parameter; and repeating the sets of the feature parameters, for which the speed control is enabled by the information, during voice synthesis in which a voice signal is synthesized by the voice synthesizer.

12. A voice processing method according to claim 11, wherein said storing step comprises the step of storing the information for enabling speech speed control irrespective of whether the synthesized speech is voiced or unvoiced.

13. A voice processing method comprising the steps of:

storing a plurality of sets of feature parameters used for voice synthesis by a voice synthesizer, and storing multi-value information for enabling or disabling speech speed control for at least each set of the feature parameters;

setting a threshold value in response to the speed with which a voice signal is to be synthesized by the voice synthesizer; and skipping or repeating the sets of feature parameters whose corresponding multi-value information are smaller than the threshold value, during voice synthesis in which the voice signal is synthesized by the voice synthesizer.

14. A voice processing method according to claim 13, wherein said storing step further comprises the steps of storing maximum multi-value information corresponding to the feature parameters representing the explosion of plosive consonants and storing multi-value information decreasing in value corresponding to the succeeding sets of feature parameters succeeding the sets of feature parameters representing the explosion of plosive consonants.

15. A voice processing method according to claim 13, wherein said skipping or repeating step comprises the step of not repeating unconditionally the sets of feature parameters if the corresponding multi-value information has a predetermined sign in said skipping or repeating step.

16. A voice processing method according to claim 13, wherein said setting step comprises the step of increasing the threshold value that is set in said setting step as the speed with which the voice signal is to be synthesized becomes faster or slower than a standard speed.

17. A voice processing method according to claim 13, wherein said storing step comprises the step of storing the information for enabling or disabling speech speed control irrespective of whether the synthesized speech is voiced or unvoiced.

* * * * *

UNITED STATES PATENT AND TRADEMARK OFFICE

CERTIFICATE OF CORRECTION

PATENT NO. : 5,189,702

DATED : February 23, 1993

INVENTOR(S) : ATSUSHI SAKURAI, ET AL.

It is certified that error appears in the above-identified patent and that said Letters Patent is hereby corrected as shown below:

COLUMN 1
Line 52, "said" should read --the--.
Line 64, "said" should read --the--.

COLUMN 5
Line 42, "period" should read --period.--.

COLUMN 7
Line 36, "without, skipping" should read --without skipping--.

COLUMN 9
Line 66, "read" should read --reads--.

COLUMN 10
Line 11, "will" should read --will be--.

Signed and Sealed this

Eighth Day of February, 1994

Bruce Lehman

*Attest:*

BRUCE LEHMAN

*Attesting Officer*

*Commissioner of Patents and Trademarks*